US005163093A

United States Patent [19]

Frielingsdorf et al.

[11] Patent Number: 5,163,093

[45] Date of Patent: Nov. 10, 1992

[54] MICROPHONE MOUNTING FOR A PERSON'S NECK

[75] Inventors: Frank Frielingsdorf, Port Jefferson; Alan Hofer, Wantagh, both of N.Y.; Peter Untersander, Ecoteaux, Switzerland

[73] Assignee: Stanton Magnetics, Inc., Plainview, N.Y.

[21] Appl. No.: 625,830

[22] Filed: Dec. 12, 1990

[51] Int. Cl.[5] ..... H04R 25/00

[52] U.S. Cl. ..... 381/151; 381/187

[58] Field of Search ..... 381/150, 151, 153, 158, 381/163, 169, 187, 168

[56] References Cited

U.S. PATENT DOCUMENTS

| | | | |
|---|---|---|---|
| D. 117,003 | 10/1939 | Woodruff et al. | 381/151 |
| 2,165,124 | 7/1939 | Ballantine | 381/151 |
| 2,260,727 | 10/1941 | Sears et al. | 381/151 |
| 2,273,078 | 2/1942 | Wright | 381/151 |
| 2,441,975 | 5/1948 | Roberton | 381/151 |
| 3,029,307 | 4/1962 | Baxt | 381/151 |
| 4,188,549 | 2/1980 | Dorais | 381/187 |
| 4,311,872 | 1/1982 | Davis | 381/187 |
| 4,685,448 | 8/1987 | Shamer et al. | 381/187 |
| 4,843,628 | 6/1989 | Hofer | 381/200 |

FOREIGN PATENT DOCUMENTS 1294506 1/1972 United Kingdom .

*Primary Examiner*—Curtis Kuntz
*Assistant Examiner*—William Cumming
*Attorney, Agent, or Firm*—Kane, Dalsimer, Sullivan, Kurucz, Levy, Eisele and Richard

[57] ABSTRACT

A mounting for a microphone includes a plate with an opening the plate being shaped and arranged so that it holds a microphone secured in said opening with the microphone contacting a person's neck. In this position the microphone can pick up sounds produced by the person through bone conduction.

15 Claims, 1 Drawing Sheet

MICROPHONE MOUNTING FOR A PERSON'S NECK

BACKGROUND OF THE INVENTION a. Field of Invention

This invention pertains to a mounting for holding a microphone secured around a person's neck, and more particularly to a microphone used to pick up the sounds produced by a person through bone conduction, said mounting being generally hidden from view for aesthetic purposes. The invention is designed for use primarily, although not exclusively, by persons who are able to generate only low-volume sounds.

b. Description of the Prior Art

As a result of various illnesses, certain people suffer from a partial disfunction of the vocal cords whereby they can produce intelligible sounds, however these sounds are of such a low volume that they are generally not heard by other people, and/or cannot be sensed by sound-sensing devices such as a telephone. In order to alleviate this problem, personal sound amplifying systems are available which make use of a microphone for picking up the low-level sounds produced by a person and coverting them into electrical signals, an amplifier for amplifying the electrical signals, and a sound reproduction means such as a speaker for reproducing the sound signals instantaneously. Preferably the microphone is an inertial type bone conduction microphone which senses vibrations generated by the vocal cords as they propagate not through the air but through the bones of the person. However until now the microphones used in these sound amplifying systems were mounted either in a helmet or by other means which made the system very visible. As a result, persons did not want to use these systems because the positioning of the microphone attracted undue attention making the wearers very self conscious and embarrassed about their infirmity.

OBJECTIVES AND SUMMARY OF THE INVENTION

In view of the above-mentioned disadvantages of the prior art, it is an objective of the present invention to provide an unintrusive means for mounting a microphone on the body of a person.

A further objective is to provide a mounting means which places the microphone in close proximity to a person's bone whereby the microphone can take advantage of, and transduce aural signals propagated by bone conduction.

Yet another objective is to provide a microphone mounting means which is relatively inexpensive.

Other objectives and advantages of the invention shall be described in conjunction with the following description of the invention.

Briefly, a microphone mounting constructed in accordance with this invention comprises a substantially flat plate with an opening and means for mounting the plate on a person's neck. The plate is designed to position a microphone disposed in the plate opening so that it is in contact with the person's neck to pick up sounds through bone conduction. A cover may be used to protect the microphone.

DETAILED DESCRIPTION OF THE INVENTION

Figure 3:
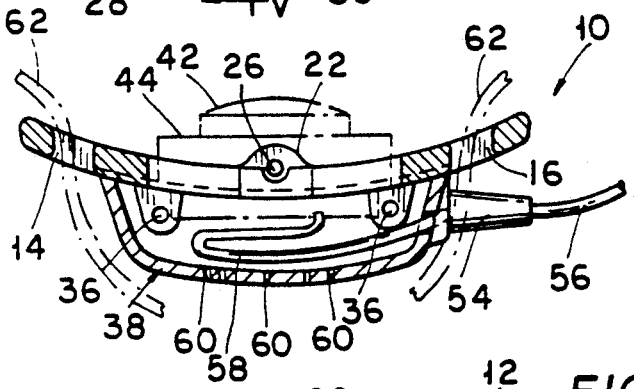
FIG. 3 shows a side-sectional view of the microphone mounting means of FIG. 1.
Figure 4:
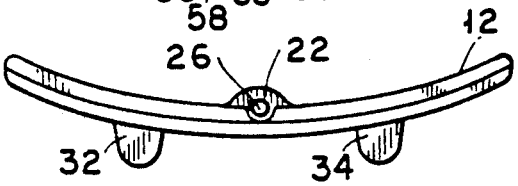
FIG. 4 shows a side view of the plate of FIG. 2.

As shown in the Figures, a microphone mounting 10 constructed in accordance with this invention includes a plate 12 having generally a rectangular shape. The plate 12 is slightly curved as seen in FIGS. 3 and 4 to conform to the shape of a person's neck. Plate 12 is provided along its two short sides with two corresponding elongated slots 14, 16. In the middle, the plate 12 is formed with a substantially circular hole 18. Disposed adjacent to hole 18 are two mounting ears 20, 22 disposed diametrically opposite each other across hole 18 and extending normally from the plate 12. Each ear 20, 22 has an opening 24, 26.

On the other side of plate 12, extending in a direction opposite ears 20, 22, the plate is also formed with four additional ears 28, 30, 32, 34. Each of these additional ears has a screw hole 36.

Figure 5:
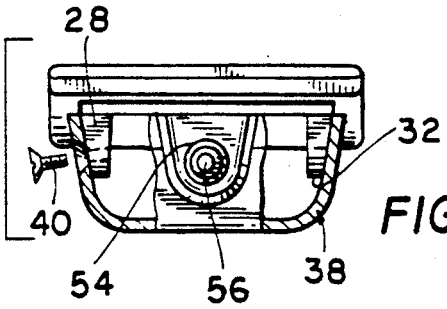
FIG. 5 shows a side-sectional view of the mounting means of FIG. 3.
Figure 6:
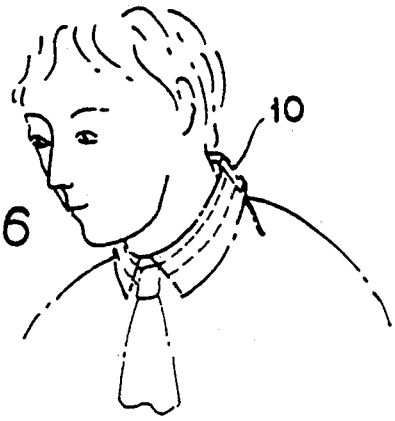
FIG. 6 shows how a microphone is mounted and worn according to this invention by a person.

The mounting also includes a cover 38 dimensioned to fit between additional ears 28, 30, 32 and 34. The cover is mounted to plate 12 by screws such as 40 which pass through the cover 38 and engage threads in screw holes 36 in the additional ears 28, 30, 32 and 34, as shown in FIG. 5.

A sound transducer, such as a miniature microphone may be secured to the mounting in a number of ways. For instance, a microphone 42 constructed in accordance with commonly assigned U.S. Pat. No. 4,843,628 may be first secured into a housing 44 having a circular depression 48 for holding said microphone. One such housing is disclosed in commonly assigned co-pending application Ser. No. 07/470,147 filed Jan. 25, 1990, entitled "Bone Conduction Microphone with mounting means" now U.S. Pat. No. 5,054,079.

Figure 1:
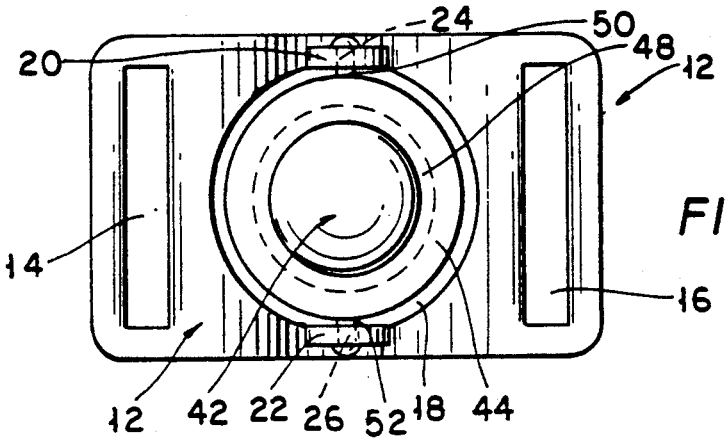
FIG. 1 shows a bottom view of mounting means with a microphone in accordance with this invention.
Figure 2:
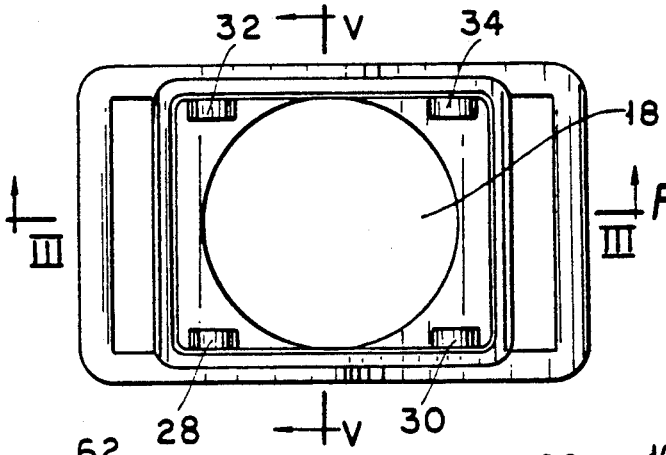
FIG. 2 shows a top view of a plate used in the mounting means of FIG. 1.

Housing 44 includes has two pins 50, 52 extending diametrically outwardly. As shown in FIG. 1, pins 50, 52 are engaged by and pass through holes 24, 26 of plate 12 to pivotally attach the housing 44 holding microphone 42 to ears 20, 22 of plate 12. Importantly pins 50, 52 allows the housing 44 and the microphone 42 attached thereto to pivot in holes 24, 26 thereby positioning the microphone.

Mounting cover 38 includes a plug 54 for holding a wire cable 56. Cable 56 carries the wires 58 connected to microphone 42 to transmit the electrical signals generated by microphone 42 in response to sounds. Cover 38 forms a chamber with the plate to protect the microphone 42 and includes a plurality of holes 60 used to equalize the pressure between the front and back of the microphone and to cancel noise.

Before use, the microphone mounting 10 is first put on by a person so that the microphone 42 is directly in contact with the neck. This may be accomplished for example by threading a strap 62 into slots 14, 16, over cover 38 as shown in FIG. 3. The strap and the mounting 10 are covered by a shirt so that they are not intrusive. In addition to shirt offers some degree of protection from ambient noise, wind rustle and the like. In addition by locating the microphone on the back of the user's neck the signal may be picked up without extraneous breathing noise or the like. Since plate 12 is in close contact with the user's neck it serves to provide further attenuation of unwanted signals. Alternatively, the microphone mounting may utilize a clip or Velcro strips in place of the strap or may be secured to a neck tie directly however, in this latter position the shirt may interfere with the operation of the microphone. The microphone mounting 10, including housing 44 may be made of a plastic material, for example by molding.

Obviously numerous modifications may be made to this invention without departing from its scope as defined in the appended claims.

We claim:

1. A microphone mounting for wearing a microphone against a person's neck, said microphone mounting comprising:

plate means including opening mean for holding a microphone;

housing means disposed in said opening means for securing said microphone; and, securing means for securing said plate to the neck of a person with said microphone oriented to contact the person's neck, said housing means being pivotally secured to said plate means.

2. The mounting of claim 1 wherein said plate means includes two opposed ends and said securing means includes two slots disposed at said opposed ends respectively.

3. The mounting of claim 1 further comprising cover means for covering said opening means.

4. A microphone mounting assembly comprising:

a relatively flat plate having a central opening and securing means for securing said plate to a person's neck;

a housing means disposed in said opening and pivotally secured to said plate; and a microphone disposed in said housing and positioned withi said central opening and secured to said plate, said plate positioning said microphone in contact with said person's neck.

5. The mounting of claim 4 wherein said plate includes two opposed ends and said securing means includes two slots disposed at said opposed ends respectively.

6. The mounting of claim 4 further comprising cover means for covering said central opening.

7. The mounting of claim 4 wherein said plate is made of a plastic material.

8. The mounting of claim 4 wherein said plate is slightly curved to correspond to the shape of a person's neck.

9. A microphone mounting comprising: a substantially rectangular flat plate having a central opening, two peripheral ears disposed diametrically adjacent to said opening, and means for securing said plate to a person's neck;

a housing pivotally mounted on said ears in said opening; a cover secured to said plate for covering said opening to form a chamber; and a microphone disposed in said housing, said plate when mounted positioning said microphone to contact directly to said person's neck, whereby said microphone can pick up sounds produced by said person through bone conduction.

10. The mounting of claim 9 further comprising a housing pivotally mounted on said ears and holding said microphone.

11. The mounting of claim 9 wherein said plate includes additional ears for securing said cover.

12. The mounting of claim 9 wherein said plate is made of a plastic material.

13. The mounting of claim 9 wherein said means for securing said plate include two slots.

14. The mounting of claim 13 wherein said means for securing said plate further includes strap means threaded in said slots.

15. The mounting of claim 9 wherein said cover includes a plurality of holes therein.

* * * * *